US006514186B2

(12) United States Patent
Catallo

(10) Patent No.: US 6,514,186 B2
(45) Date of Patent: Feb. 4, 2003

(54) HIGH SPEED FABRIC FOLDER

(76) Inventor: Frank Catallo, 84 Wheatley Rd., Old Westbury, NY (US) 11568

( * ) Notice: Subject to any disclaimer, the term of this patent is extended or adjusted under 35 U.S.C. 154(b) by 31 days.

(21) Appl. No.: 09/885,180

(22) Filed: Jun. 20, 2001

(65) Prior Publication Data

US 2002/0198091 A1 Dec. 26, 2002

(51) Int. Cl.[7] ..... B31F 1/00
(52) U.S. Cl. ..... 493/414; 493/415
(58) Field of Search ..... 493/397, 405, 493/413, 414, 415, 434, 442, 451

(56) References Cited

U.S. PATENT DOCUMENTS 2,395,983 A * 3/1946 Wyrick ..... 493/414
5,104,366 A * 4/1992 Bunch ..... 493/23
5,592,564 A * 1/1997 Shigeoka et al. ..... 382/158
5,957,827 A * 9/1999 Barrus et al. ..... 493/323

FOREIGN PATENT DOCUMENTS

JP 54-156727 * 11/1979

* cited by examiner

*Primary Examiner*—Ted Kavanaugh
(74) *Attorney, Agent, or Firm*—Charles E. Baxley

(57) ABSTRACT

A folder for fabric includes a traversing assembly which receives a fabric web and deposits the fabric in a Z fold as the traversing assembly reciprocates relative to a base. A pressing assembly includes a pair of pressing rollers which move in a direction substantially parallel to the surface of the folded fabric. A pressing roller presses on the fabric as it moves toward the fold. Shock absorber assemblies absorb stress at the ends of strokes of the traversing assembly as it reciprocates relative to the base.

11 Claims, 4 Drawing Sheets

HIGH SPEED FABRIC FOLDER

BACKGROUND OF THE INVENTION

1. Field of the Invention

The present invention relates generally to equipment for folding fabric, in continuous webs or tubes, and more particularly to a high speed fabric folder suitable intr alia for knitted textiles.

2. Background of the Invention

After being knitted and processed, a knitted fabric usually is batched either in roll form or folded for delivery to be cut and sewn to make garment. With more cutting and sewing being done remote from knitting mills, delivery of knitted fabrics in folded form is increasing in popularity. Large folded bundles typically are shipped in containers to be cut and sewn into garments. In order to transport the large bundles efficiently without distortion a folded pile is required to be neat and accurate in size. Speed at which a fold is made also is an important economic concern. According to the prior art, in order to provide a neat folded pile, machines had to be slowed down; especially when traversing type folders are used. Reciprocating motion involving change in direction of traversing rolls create extreme impact forces. In addition a requirement to pat down or press an end of each fold with flaps or other means adds to impact stress imposed on the folding mechanism. Many attempts have been made to reduce the impact stress without adversely affecting quality of folding.

One such attempt is described in U.S. Pat. No. 4,175,738. In the '738 folder there is an attempt to reduce the impact stress resulting from change in direction of a traversing roll by slowing down the roll at the end of its stroke. This '738 folder requires a relatively complex mechanical assembly including a yoke and slide mechanism and a relatively complex gear assembly.

Despite achievements of prior art folders there remains a need for a simple and effective folder, particularly for knitted fabrics, which can operate satisfactorily at an acceptly rapid rate of speed within acceptable impact stress levels.

OBJECTS AND SUMMARY OF THE INVENTION

It is an object of the present invention to use impact stress caused by the pressing assembly in a high speed folder to reduce the impact stress caused by the traversing assembly to an acceptable level.

Another object of the present invention is to provide a high speed fabric folder which incorporates a shock absorbing means to reduce shock imposed by impact stress on the folder's traversing assembly.

Another object of the present invention is to provide a high speed fabric folder which incorporates a traveling roll to press the pile of folded fabric.

Another object of the present invention is to provide a high speed fabric folder which operates in a safe and reliable manner within acceptable impact stress levels.

Another object of the present invention is to provide a high speed fabric folder which reduces impact stress on the folding mechanism without adversely affecting the quality of folding or speed of operation.

Another object of the present invention is to provide a high speed fabric folder which produces a uniform length of fold and a neat folded pile.

Yet another object of the present invention is to provide a high speed fabric folder which comprises a relatively small number of component parts and which can be manufactured economically resulting in a relatively low overall cost.

The foregoing and other objects and features of the invention will appear more clearly hereinafter.

In accordance with the present invention, there is provided a high speed fabric folder which includes a traversing assembly mounted on a base. The traversing assembly includes fabric conduit means which receive a fabric web and deposit the fabric in a Z fold or fan fold as the traversing assembly reciprocates relative to the base.

A pressing assembly which includes a pair of pressing rollers is mounted on the traversing assembly. The pressing roller moves in a direction that is substantially parallel to the surface of the folded pile of fabric and presses lightly on the pile of fabric as it moves toward the fold.

Shock absorber assemblies absorb impact stress at the ends of strokes of the traversing assembly as it reciprocates relative to the base.

DESCRIPTION OF THE DRAWING

The foregoing and other important objects and advantages of the invention will be apparent from a detailed description which follows taken in connection with the accompanying drawings in which.

DETAILED DESCRIPTION OF THE INVENTION

With reference to the drawings, in which the reference numbers designate like or corresponding parts throughout, there is shown in FIGS. 1–4 a high speed fabric folder generally designated by reference number 10, in accordance with the present invention, which includes a base 12 which supports a drive motor 14 and a traversing assembly which forms a key feature of the present invention.

Figure 4:
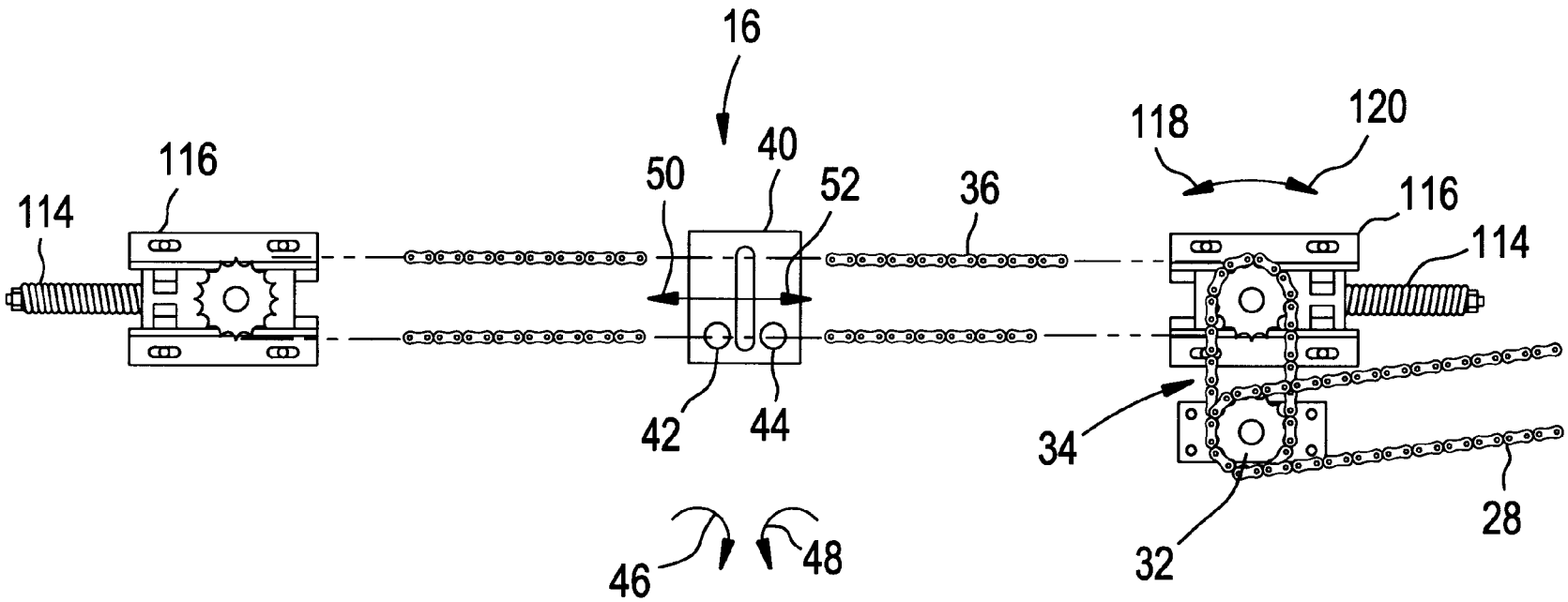
FIG. 4 is a fragmentary cross-sectional view taken along the line 4—4 of FIG. 2.

The drive motor 14 is connected to a gearhead 18 which drives a belt 20. The drive belt 20 drives a drive shaft 22 which is mounted in pillow blocks 24,26. The drive shaft 22 in turn, drives the traversing assembly 16 via a drive chain 28. As is best shown in FIG. 4 the drive chain 28 drives the lower sprocket 32 of the sprocket and chain assembly 34.

The sprocket and chain assembly 34 has a substantially vertical orientation, which is generally at right angles to the drive chain 28. This orientation allows the sprocket and chain assembly 34 to swing like a pendulum or float when the drive chain 36 moves laterally at the end of each stroke, as indicated by arrows 118,120 in FIG. 4.

This lateral motion or float of the drive chains 36,38 which is consistent at any one drive speed produces a uniform length of fold.

The drive chain 36 drives the traversing plates 40 which support the traversing rollers 42,44 as is shown in FIGS. 1–4. Traversing rollers 42,44 rotate in the direction shown by the arrows 46,48 in FIG. 4; while traversing in the directions shown by arrows 50,52 in FIG. 4 to deposit fabric 54 one layer at a time onto the table 56.

Figure 1:
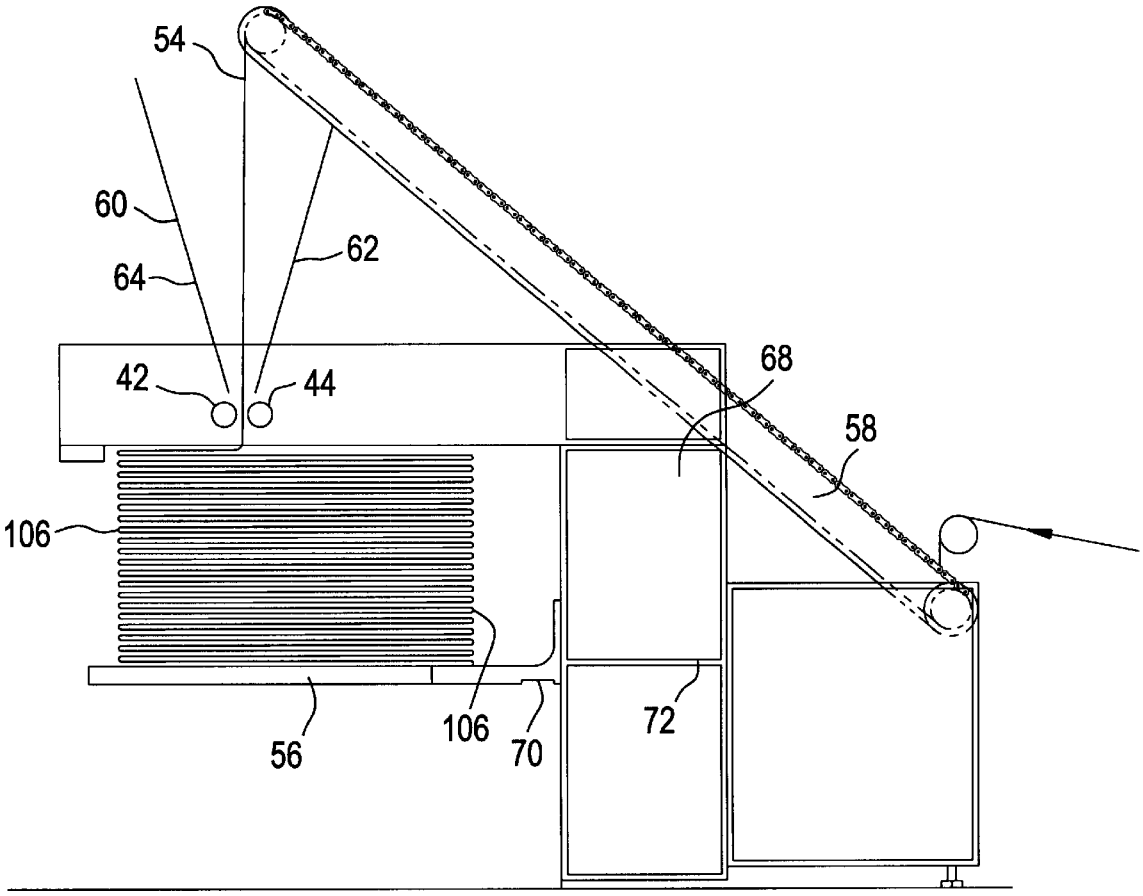
FIG. 1 is a fragmentary schematic elevational view of a high speed fabric folder in accordance with the present invention.

As is shown in FIG. 1, the fabric 54 which is in the form of a web is initially deposited on a conveyor 58 which carries the fabric 54 upward and drops the fabric 54 between plates 60,62 which form a chute 64. The fabric 54 then moves between the traversing rollers 42,44 for deposit on the table 56 one layer 66 at a time as the table 56 drops to accommodate the fabric layers 106 as they build up. The mechanism 68 which lowers the table 56 is connected to the table 56 support bracket 70 as is shown schematically in FIG. 1. The mechanism 68 which lowers the table 56 is located in the housing 72 and is conventional in nature and has therefore not been illustrated in detail.

Figure 2:
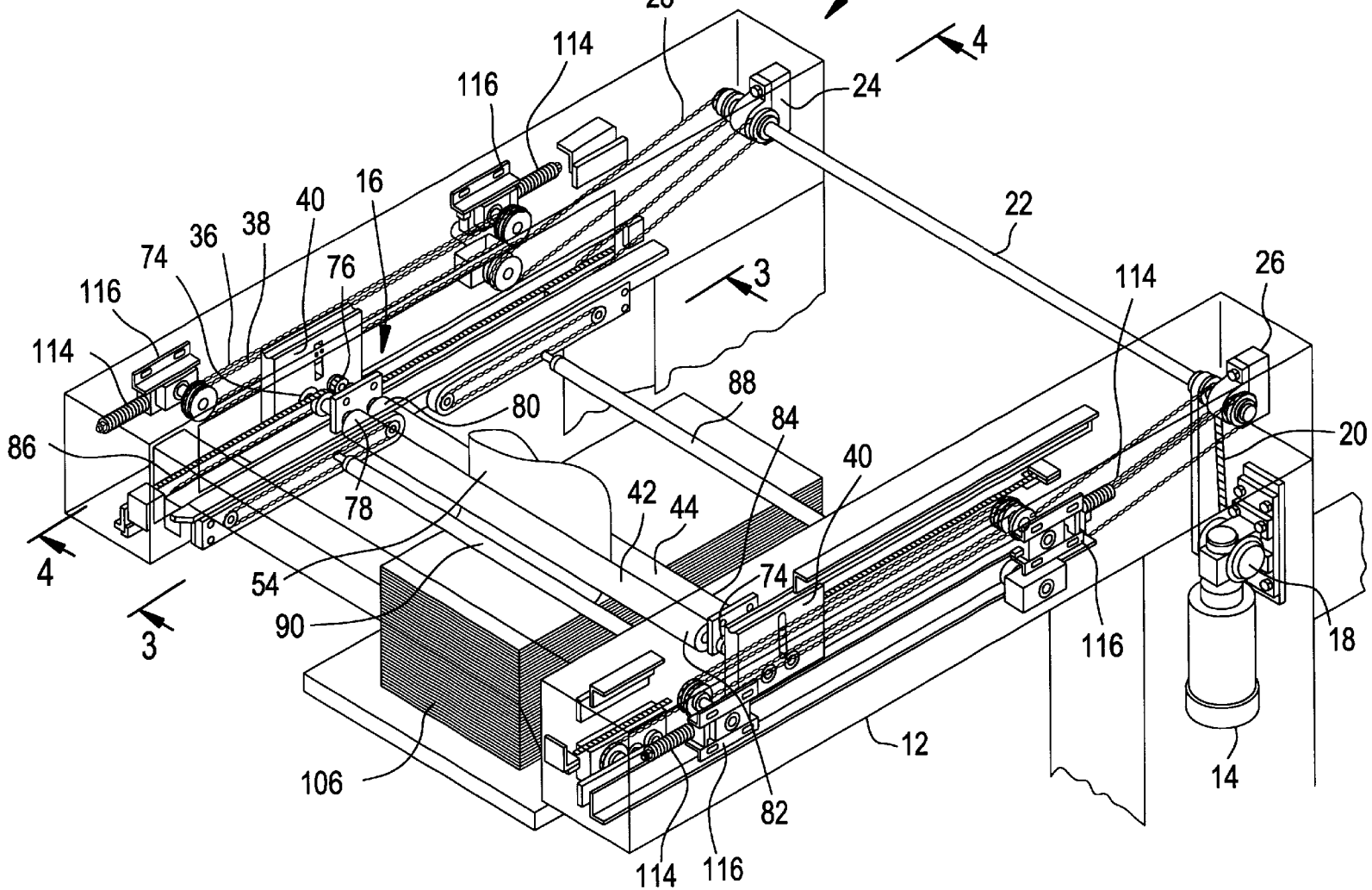
FIG. 2 is an overall perspective view of the high speed fabric folder of FIG. 1 with a conveyor and a chute removed for clarity of illustration.

The traversing assembly 16 includes one-way clutches 74,76 mounted at each end 78,80,82,84 of the traversing rollers 44,42. The one-way clutches 74,76 are in engagement with a timing belt 86 as is shown in FIG. 2.

Figure 3:
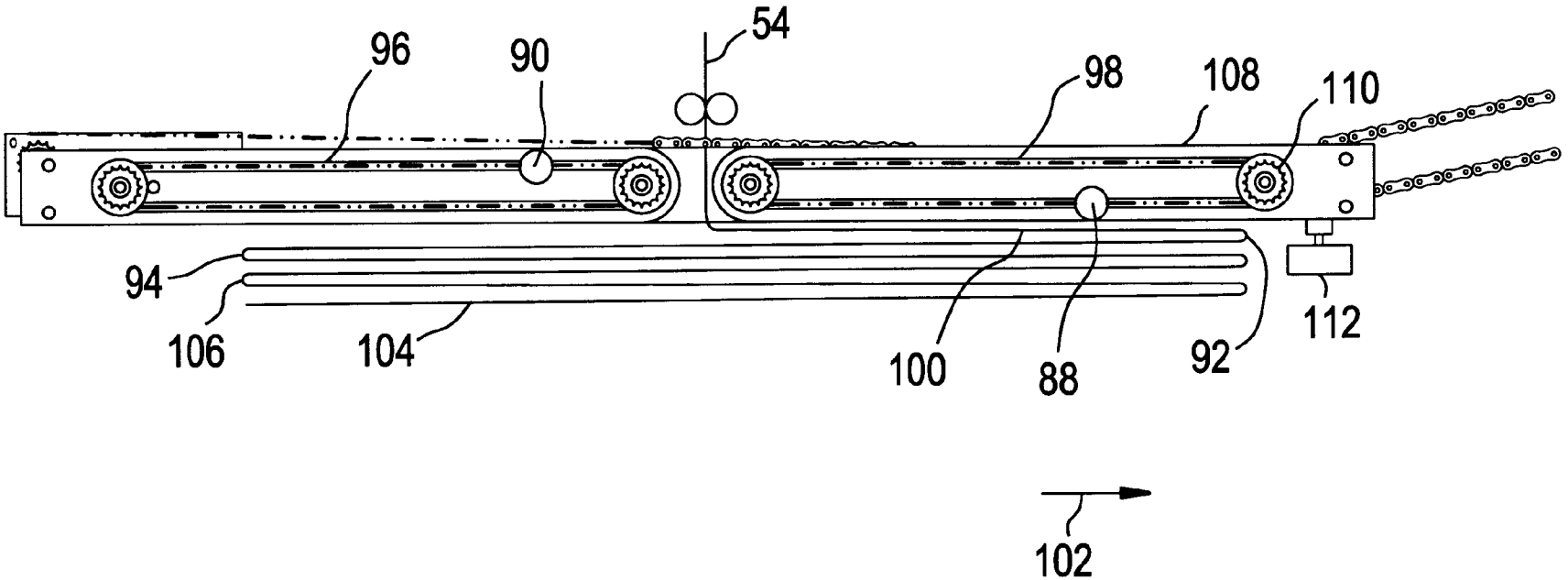
FIG. 3 is a fragmentary cross-sectional view taken along the line 3—3 of FIG. 2.

FIG. 3 shows the operation of the pressing rollers 88,90 which press or iron-out the ends 92,94 of each fold 106. The pressing rollers 88,90 are mounted on belts 96,98. As is shown in FIG. 3, pressing roller 88 has been lowered onto the last fold 100 some distance away from the end 92 of the folded pile 104 and then the pressing roller 88 is moved by the belt 96 toward the end 92 of the folded pile 104 in the direction shown by the arrow 102 ironing out and pressing down on the newly produced loose fold 100. The speed of the traversing assembly 16 is synchronized with the speed of the pressing rollers 88,90.

This traversing and pressing motion is smooth and can operate at relatively high speed as compared to the typical up and down flap method commonly used to flatten the folds of the pile of fabric in devices in the prior art.

As is shown in FIG. 3, the belts 96,98 which control the path of travel of the pressing rollers 88,90 raise the roller before it returns to press or iron-out the next fold. The raised roller does, not disturb the last fold and the roller comes down between the approximte center of the pile of fabric 104 and the last fold and then travels on the pile 104 ironing-out the fabric and pressing down on the fold. Downward pressure on the rollers 88 lifts the chain housing 108 which is pivotally mounted at pivot 110 and actuates an electrical switch 112 as the roller travels past the end 92 and the fold 100. Actuation of the electrical switch 112 operates the mechanism 68 to lower the table 56 by approximately the thickness of the fabric 54.

As is best shown in FIG. 4, spring assemblies 114, which are mounted on support brackets 116, absorb the energy of the traversing assembly 16 at the end of each reciprocating stroke when the traversing assembly 16 and drive chain 38 change direction.

The lateral motion or float of the drive chain 36 which is the reult of the inertia force of the various moving components and the spring forces is consistent at any one drive speed and therefore produces a uniform length of fold.

The foregoing specific embodiment of the present invention as set forth in the specification herein is for illustrative purposes only. Various deviations and modifications may be made within the spirit and scope of this invention, without departing from a main theme of invention specified in claims which follow hereafter.

I claim:

1. A high speed fabric folder for folding a web or tube of fabric and a base, a drive motor operatively mounted relative to the base, a traversing assembly connected to the base, a driving connection operatively connecting the drive motor and said traversing assembly to impart reciprocating movement of the traversing assembly relative to the base, a fabric conduit means operatively associated with the traversing assembly for forming folds in the fabric as the traversing assembly and the fabric conduit means reciprocate relative to the base, a pressing assembly mounted in operative association with the traversing assembly with the pressing assembly comprising a pressing member disposed for motion in a direction substantially parallel to and opposite to the reciprocating movement of the traversing assembly.

2. The high speed fabric folder as claimed in claim 1 with a pair of shock absorber means each disposed at an opposite end from the other to attenuate thereat the reciprocating motion of the traversing assembly.

3. The high speed fabric folder as claimed in claim 2 in which each of the shock absorber means comprises a spring.

4. The high speed fabric folder as claimed in claim 1 in which the pressing assembly comprises a pair of pressing rollers.

5. The high speed fabric folder as claimed in claim 4 in which the pair of pressing rollers are each disposed for projecting below the traversing assembly one roller at a time, for pressing contact with the fabric as it is deposited by the traversing assembly.

6. The high speed fabric folder as claimed in claim 5 in which each of the pressing rollers is mounted on an endless belt.

7. The high speed fabric folder as claimed in claim 5 in which the pressing roll is disposed projecting in a downward direction and is driven in a direction opposite to the motion of the traversing assembly.

8. The high speed fabric folder according to claim 1 in which the driving connection comprises a drive chain.

9. The high speed fabric folder according to claim 1 in which the traversing assembly and the pressing assembly are constrained by a first driving connection and a second driving connection to move in a timed directionally opposite relationship each relative to the other.

10. A high speed fabric folder as claimed in claim 1 in which the driving connection comprises in combination:

a first driving connection, a second driving connection, and a third driving connection with the first driving connection operatively connecting the drive motor to the second driving connection, with the second driving connection operatively connecting the first driving connection and the third driving connection, and with the third driving connection connecting the second driving connections and the traversing assembly.

11. A high speed fabric folder as claimed in claim 10 in which the second driving connections are pivotally mounted on the base.

* * * * *